United States Patent [19]

Harrison

[11] Patent Number: 4,924,947

[45] Date of Patent: May 15, 1990

[54] BENTLEG PLOW

[75] Inventor: H. Page Harrison, Edmonton, Canada

[73] Assignee: The Governors of the University of Alberta, Edmonton, Canada

[21] Appl. No.: 190,827

[22] Filed: May 6, 1988

[51] Int. Cl.[5] ..... E02F 3/80

[52] U.S. Cl. ..... 172/701.1; 172/681

[58] Field of Search ..... 172/815, 192, 681, 701.1, 172/716

[56] References Cited

U.S. PATENT DOCUMENTS 3,041,753 7/1962 Koloseus ..... 172/816

*Primary Examiner*—Timothy V. Eley

*Attorney, Agent, or Firm*—Shoemaker and Mattare, Ltd.

[57] ABSTRACT

An improved bentleg plow has an upper blade-like portion with a leading edge extending forwardly and downwardly, and a lower blade-like portion connected to the upper portion and extending downwardly, forwardly and laterally. The lower portion has a rake angle, typically 15 degrees, with respect to the forward direction, which angle tends to improve performance. The take angle is defined as the angle made to the horizontal by the intersection of the lower portion of the bentleg plow with a vertical plane parallel to the forward direction.

5 Claims, 4 Drawing Sheets

BENTLEG PLOW

This invention relates generally to the agricultural tilling of crop land, and has to do particularly with the design of a subsoil plow.

BACKGROUND OF THIS INVENTION

For hundreds of years, the standard soil-tilling device has been the mold-board plow. The traditional shape for the mold-board plow includes a curved blade converging to a point in the forward direction, the curvature acting to lift a slice of earth and turn it over. Typically, several such mold plow blades are mounted on a single frame in a diagonal pattern.

More recently, a differently shaped plow has been introduced, called the bentleg plow. Such a plow is described by Williams, M., in an article entitled "Enter—A New Kind of Plow", appearing in the October, 1981 edition of *Power Farming*. The known shape of a bentleg plow includes an upper leg in the form of a flat plate with its leading edge rotated ahead by about 25 degrees, and a lower leg which is bent at about 45 degrees to the side. The lower leg also has a forward rotation of its leading edge. When the bentleg plow is drawn through soil, the lower leg tends to loosen the soil above it.

The known bentleg plow is typically made from an appropriately shaped piece of steel plate, with the lower leg portion bent with respect to the upper part about a line which is parallel with the direction in which the bentleg plow is drawn through the soil. This means that the lower leg lies in an oblique plane which is parallel with the direction of movement.

GENERAL DESCRIPTION OF THIS INVENTION

It is an object of one aspect of this invention to provide a novel design for a bentleg plow, having an improved ability to loosen soil.

An object of another aspect of this invention is to provide a design for a bentleg plow which is simple to fabricate, and of low cost.

An object of another aspect of this invention is to provide a bentleg plow design that is energy efficient, and reduces the number of legs required for a given width of cut.

More particularly, this invention provides a bentleg plow apparatus having a forward direction, the apparatus comprising:

mounting means, an upper blade-like portion secured to said mounting means and extending generally downwardly from said mounting means a lower blade-like portion connected to said upper portion and extending downwardly and laterally therefrom, the lower portion having a rake angle with respect to the forward direction, the rake angle being defined as the angle made to the horizontal by the intersection of the lower portion with a vertical plane parallel to said forward direction, the rake angle being such that the lower portion seeks to penetrate further into soil being plowed as the plow apparatus is moved in said forward direction.

In addition, this invention provides a method of making a bentleg plow, comprising the steps:

(a) cutting from a metal plate a tetragon having a top edge, a leading edge defining an obtuse angle with the top edge, a trailing edge defining an acute angle with the top edge, the leading edge and the trailing edge converging toward each other in the direction away from the top edge, and a bottom edge connecting the leading and trailing edges, the tetragon having a top portion adjacent the top edge, and a bottom portion adjacent the bottom edge, (b) and bending the bottom portion with respect to the top portion about a hinge line joining intermediate locations along the leading and trailing edges, the line being such that the bottom portion has a rake which seeks to draw the plow more deeply into soil being plowed when the plow is drawn along a path parallel with the top edge in the direction from the trailing edge to the leading edge.

Finally, this invention provides a method of making a plurality of bentleg plow blades, comprising the steps:

(a) providing a length of steel plate defined between two parallel edges, (b) cutting from the steel plate a plurality of substantially identical trapezoids, each trapezoid having (1) a top edge along one of said parallel edges of the steel plate, (2) a leading edge defining an obtuse angle with the top edge and extending between said parallel edges, (3) a trailing edge defining an acute angle with the top edge and extending between said parallel edges, the leading edge and the trailing edge converging toward each other in the direction away from the top edge, and (4) a bottom edge along the other parallel edge and connecting the leading and trailing edges, each tetragon having a top portion adjacent the top edge, and a bottom portion adjacent the bottom edge, (c) and bending the bottom portion of each trapezoid with respect to the top portion thereof about a hinge line joining intermediate locations along the leading and trailing edges, the hinge line being such that the bottom portion has a rake which seeks to draw the plow more deeply into soil being plowed when the plow is drawn along a path parallel with the top edge in the direction from the trailing edge to the leading edge.

GENERAL DESCRIPTION OF THE DRAWINGS

Two embodiments of this invention are illustrated in the accompanying drawings, in which like numerals denote like parts throughout the several views, and in which.

Figure 7:
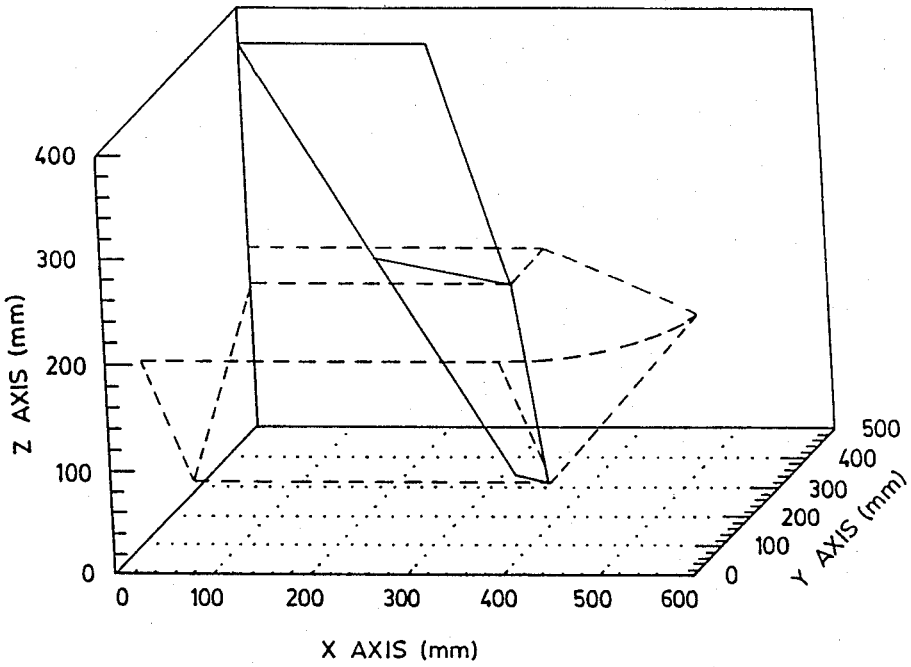
Figure 8:
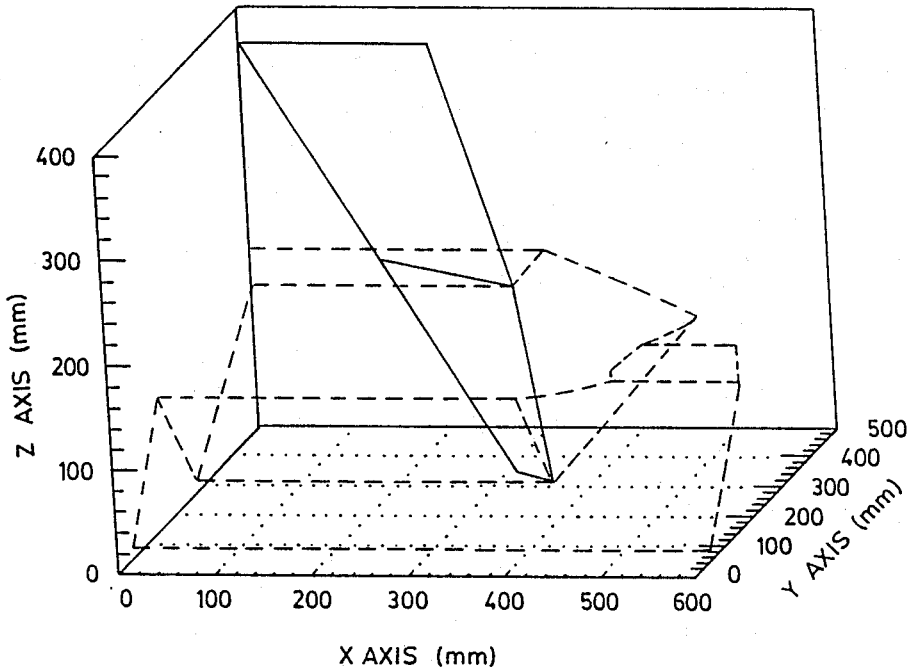
Figure 9:
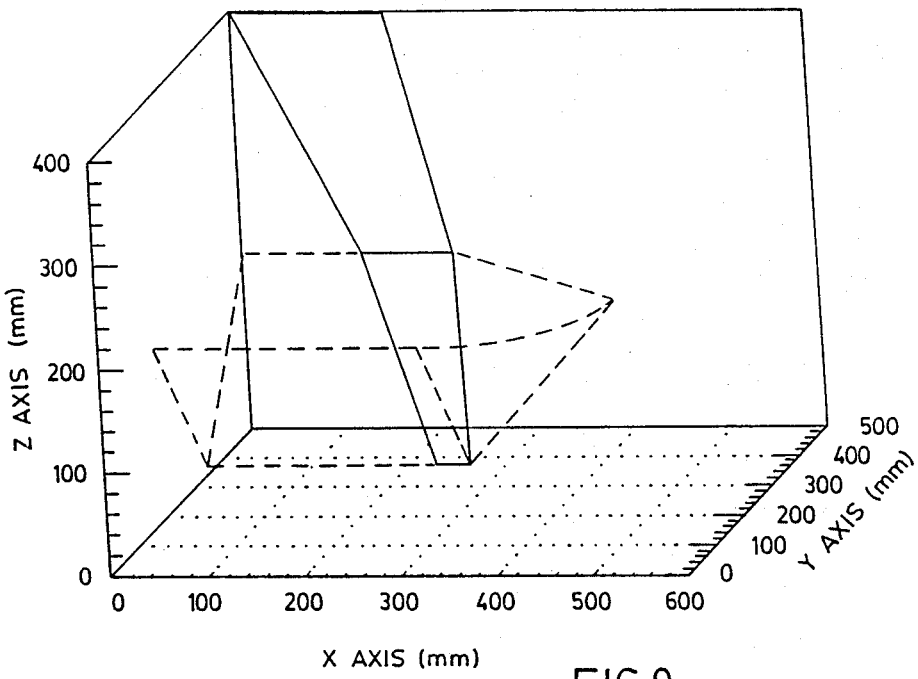
Figure 10:
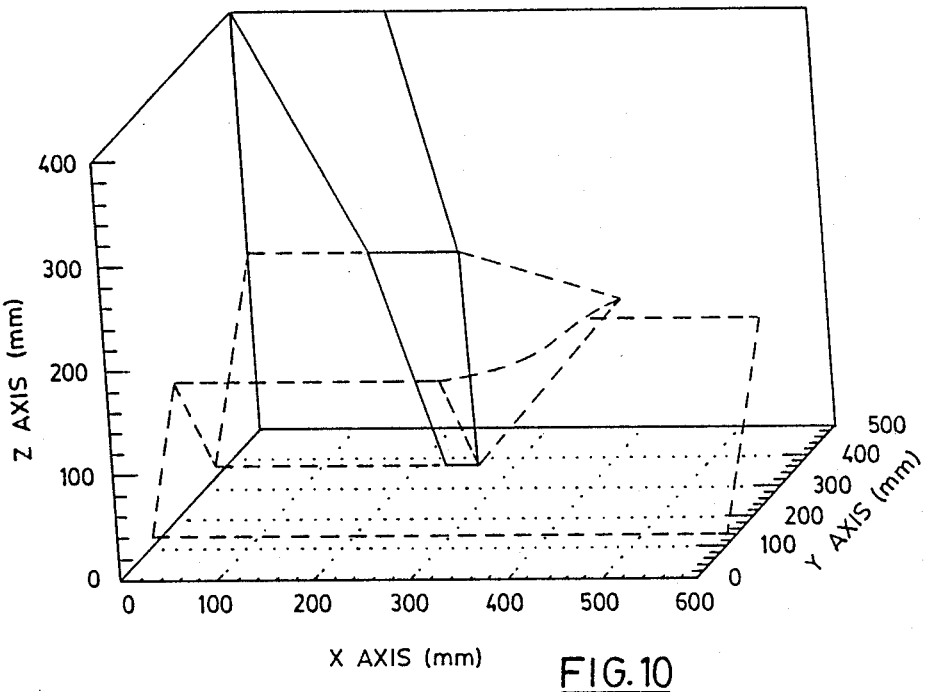
Figure 11:
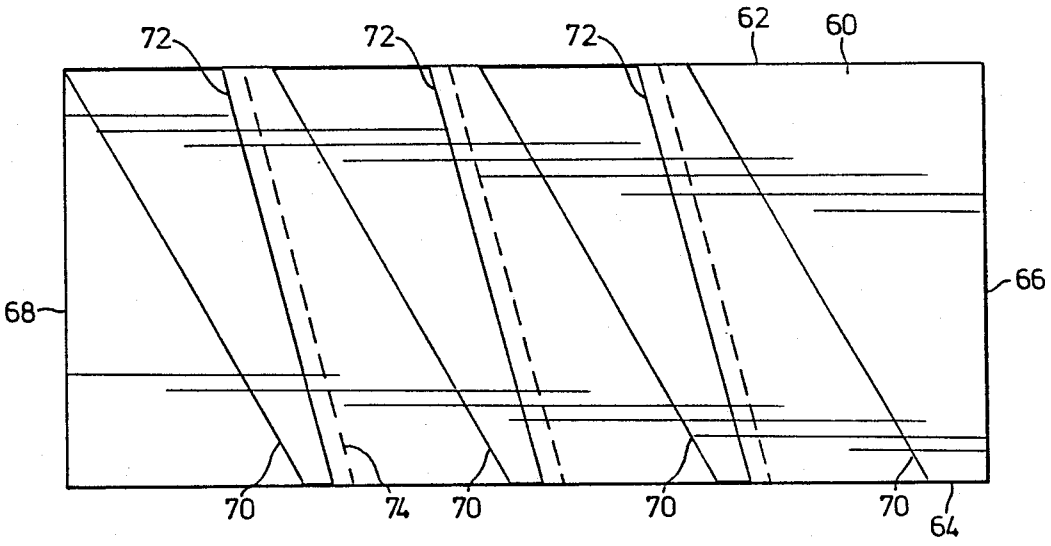

FIG. 7 schematically illustrates the soil tilling boundaries for the first embodiment, in the absence of a prior leg;

FIG. 8 illustrates schematically the soil tilling boundaries for the first embodiment with a prior leg;

FIGS. 9 and 10 are similar to FIGS. 7 and 8 respectively, but show the soil tilling boundaries for the second embodiment of this invention; and FIG. 11 shows a cutting layout for paired right and left-hand bentleg plows, cut from a single piece of steel plate.

DETAILED DESCRIPTION OF THE DRAWINGS

Figure 1:
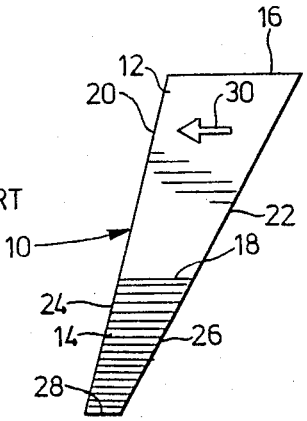
FIG. 1 PRIOR ART
FIGS. 1 and 2 are a side elevation and a front elevation of a conventional bentleg plow representing the prior art.
Figure 2:
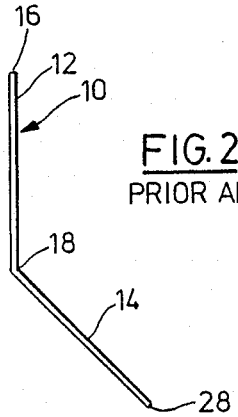
FIG. 2 PRIOR ART

Attention is first directed to FIGS. 1 and 2, illustrating the conventional bentleg plow. The plow is shown generally at 10, and includes an upper portion 12 and a lower portion 14. The upper portion 12 is in the shape of a trapezoid having a top edge 16, a bottom edge 18, a leading edge 20 and a trailing edge 22. As can be seen, the leading edge 20 is rotated ahead by 15 degrees, assuming that the plow is to be utilized in the position shown in FIG. 1. In this position, the top edge 16 and the bottom edge 18 are parallel and are horizontal. The trailing edge 22 forms with the vertical an angle of 30 degrees. The bottom edge 18 of the top portion 12 is a bend line from which the lower portion 14 extends laterally and downwardly at 45 degrees to the horizontal. The lower portion has a leading edge 24, a trailing edge 26, and a bottom edge 28. The arrow 30 illustrates the forward direction for the bentleg plow 10 in FIG. 1.

Figure 3:
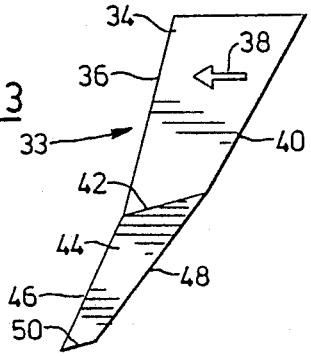
FIGS. 3 and 4 are a side elevation and a front elevation of one embodiment of this invention.
Figure 4:
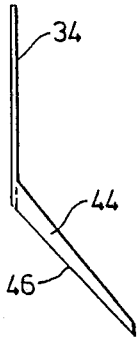

Attention is now directed to FIGS. 3 and 4, which illustrate the first embodiment of the present invention.

In FIG. 3, the bentleg plow shown generally at 33 has an upper blade-like portion 34 with a leading edge 36 extending forwardly and downwardly with respect to the forward direction illustrated by the arrow 38. In the embodiment illustrated, the angle between the leading edge 36 and the horizontal is 15 degrees. The upper portion 34 also has a trailing edge 40, this being angled to the vertical by 30 degrees. A fold or bend line 42 defines the lower edge of the upper portion 34. As can be seen in FIG. 3, the line 42 defines an angle of 15 degrees with the horizontal.

In FIG. 3, a lower blade-like portion 44 is illustrated, this being integrally connected with the upper portion 34 at the bend line 42. The lower portion 44 extends downwardly, forwardly and laterally from its connection to the upper portion 34, as can be seen in FIG. 4. The lower portion has a leading edge 46, a trailing edge 48, and a bottom edge 50. Because of the angulation of the bend line 42 with respect to the horizontal, the lower portion 44 is provided with a rake angle with respect to the forward direction. For purposes of this specification, the rake angle will be defined as the angle made to the horizontal by the intersection of the portion 44 with a vertical plane that is parallel to the forward direction defined by the arrow 38. Using this definition, it will be understood that the rake angle is the same as the angulation of the bend line 42 with respect to the horizontal. It will further be noted that the rake angle is such that the lower portion 44 will seek to penetrate or draw itself further downwardly into soil being plowed.

While the rake angle for the embodiment of FIG. 3 has been shown as 15 degrees, it will be understood that departures from this specific angle are contemplated. Generally, a rake angle in the range from about 10 degrees to about 20 degrees is contemplated.

In FIG. 4, the leading edge 46 of the lower portion 44 is seen to define an angle of 45 degrees with a horizontal plane. However, the leading edge 46 does not itself lie in a plane parallel with the drawing sheet, and for this reason the angulation can be expressed by saying that a plane parallel to the forward direction (arrow 38) and containing the leading edge 46 of the lower portion 44 will itself define with the horizontal plane an angle of substantially 45 degrees.

Figure 5:
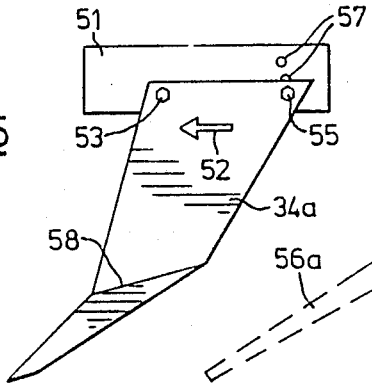
FIGS. 5 and 6 are a side elevation and a front elevation of a second embodiment of this invention.
Figure 6:
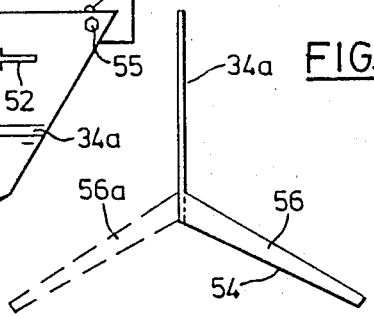

The embodiment shown in FIGS. 5 and 6 is similar to that shown in FIGS. 3 and 4, except that the angulation of the lower leg with respect to the horizontal is 30 degrees rather than 45 degrees. Again, this is more accurately expressed by saying that a plane parallel to the forward direction (arrow 52) and containing the leading edge 54 of the lower portion 56 defines with a horizontal plane an angle of substantially 30 degrees. It is not necessary to describe again all of the various edges and boundaries for the embodiment of FIGS. 5 and 6, since these are the same as for the embodiment of FIGS. 3 and 4. It can be noted, however, that the bend or fold line 58 defining the junction of the upper portion and the lower portion of the bentleg plow is again at 15 degrees, which means that the rake angle (as defined earlier) for the embodiment of FIGS. 5 and 6 is again 15 degrees.

While specific angles for the rake and the various edges have been identified as characterizing the particular embodiment shown in FIG. 5, it will be appreciated that these various angles, and in particular the rake angle, can be varied or adjusted by simply rotating the bentleg plow about a horizontal axis at right angles to the forward direction identified by the arrow 52. In FIG. 5, a member 51 represents a portion of a frame to which the plow blade is secured. One point of securement is identified as the axis of a hex bolt 53 passing through a suitable aperture in the upper portion **34*a*. The upper portion 34*a* also has a further aperture to receive a second hex bolt 55, and the member 52 has a plurality of openings 57, all equidistant from the opening through which the bolt 53 passes. It will be understood that the angulation of the rake and the various edges can be altered by selecting a different one of the apertures 57 for receiving the hex bolt 55**.

A constructional variation of this invention is shown in broken lines in FIG. 6. In this figure, the upper portion **34*a* has secured to it not only the solid-line lower portion 56 extending downwardly to the right, but also a second "mirror image" lower portion 56*a* extending downwardly to the left. In the preferred embodiment of this bilaterally symmetrical plow blade, both of the lower portions 56 and 56*a*** are identical but reversed. Thus, they would have the same rake angles and the same general disposition.

Attention is now directed to FIG. 11, which shows a piece of steel plate 60 having two parallel side edges 62 and 64, and two end edges 66 and 68. The plate 60 is cut or sheared along a first plurality of oblique lines 70, and is severed obliquely along a second plurality of diagonal lines 72. In this embodiment, the cuts at 72 are beveled, and the broken lines 74 designate the intersection of the cut with the far surface of the plate 60. The trapezoids resulting from the various cuts are substantially identical, but not entirely so due to the angulation or bevel of the cut 72. By making the cut 72 on an angle with respect to the main surface of the plate 60, the result is that half the cut pieces have a left angulated leading edge, and half have a right angulated leading edge. It will thus be seen that, except for the initial cut, only one cut per leg would be required if plate in a suitable width was available.

Although the angles for the leading and trailing edges of the embodiments illustrated in FIGS. 3–6 are 15 and 30 degrees respectively, it should be noted that angles other than those shown could be used without adversely affecting the fabrication technique described above. The choice of specific angle will depend upon the magnitude of the soil reacting forces and the thickness of the steel plate.

The designs shown for the first and second embodiment were initially fabricated from sheet metal for a visual confirmation of the design, and then were subsequently used to indicate the relative rigidities. To determine the latter quality, the sheet metal models were fixed in a vertical plane so that a weight when hung from the model extremity would simulate a draft force, albeit concentrated at the extremity. The deflections of the extremities are given in Table 1 for a force of 30N. As can be seen, the inclusion of a rake angle increased the rigidity of the 45 degree model by nearly 100%. The much smaller increase (less than 25%) for the 30 degree model is still of consequence, since it had a much longer soil-leg interface than the 45 degree models. Some buckling in the legs indicated a bending force about a longitudinal axis, as well as the expected torsional force about a vertical axis.

EXPERIMENTAL VERIFICATION

The soil reacting forces for different depths and spacings were determined using a six cell dynamometer and a laboratory soil. The soil was silty loam with a moisture content between 18 and 22% (dry basis). It was rototilled and then packed with a roller for a soil density which varied from 1000 to 1100 kg/m3 (dry basis). This procedure created a density which was maximum at the soil surface and diminished with depth—a density profile opposite to typical field conditions. Also the soil was not 'scaled' by adding anything to it except water; consequently, comparisons to other experimental data on bentleg plows should not be attempted.

The depths and spacings used for the half scaled models are listed in Table 2. Although it complicated the comparison between the 30 and the 45 degree models, the spacings were chosen so that the height of the untilled ridge beneath the soil surface was the same for all three. The 'no prior leg' designation defines the model as if it were the front or lead tool on an implement; that is, there was no soil tilled by a prior leg. The maximum depth was limited to 160 mm because of the laboratory equipment.

The soil reactions were analyzed for three different combinations of tillage depth, leg spacing, rake and leg angle. These were:

- 45 degree bentleg plows with and without a rake angle (15 and 0 degrees) for two tillage depths, two spacings of a prior tilling leg and without a prior tilling leg, on a per leg basis,
- 45 and 30 degree bentleg plows both with a 15 degree rake angle without prior tilling legs for two tillage depths, on a per leg basis,
- 45 and 30 degree bentleg plows both with a 15 degree rake angle with prior tilling legs for two depths, on a per meter of spacing.

In general, the main effects for the leg and rake angle, depth and spacing were significant for the three soil reacting forces, as were many of the interactions (see Tables 3 and 5). The means for the main effects are given in Tables 4, 6 and 7.

The rake angle had little or no effect on the draft, which was most encouraging (Table 4). Also encouraging was the response of the vertical reaction. The rake angle created a large decrease in the vertical reacting force which would aid the bentleg plow to penetrate if and when penetration is a problem. The decrease does support the idea that a submerged tine for the bentleg plow may be unnecessary if there is a rake in the soil-leg interface. The large increase in the lateral direction due to the rake angle would cause the implement to skew unless landslides or right and left facing plows were used. The increase in the soil reactions due to increases in depth and spacing could have been anticipated.

The draft for the 30 degree leg was nearly 30% greater than for the 45 degree leg when there was no soil tilled by a prior leg (see Table 6). This difference was largely attributed to differences in the length of the soil-leg interface and is inferred by the small difference in the draft on a per meter of spacing (see Table 7). The volume of soil stressed by the 30 degree leg is larger than for the 45 degree leg unless truncated by a prior leg, as noted below.

There is no change in the vertical reaction for a change in the leg angle if there was no prior leg. On the other hand there was an increase for a decrease in the leg angle if there was a prior leg (see Table 6). These responses suggest that penetration may be more difficult in some circumstances with the 30 degree bent angle than for the 45 degree angle. Any differences in the lateral direction are not important if right and left hand bentleg plows are used on the same implement frame. Draft responses for changes in the tillage depth and leg spacing were anticipated.

Most of the interactions (simple effects) which tested significant in Table 4 are attributed to the presence or absence of a prior tilling leg, similar to the response of the force reactions already noted for the main effects. The interactions were a function of the volume of soil stressed by the soil-leg interface and which were localized by a prior tilling leg.

The models tilled a 'V' shape trough of soil (see FIGS. 7–10) with one side created by the leading edge of the leg, and the other by the soil-leg interface causing the soil to fail in shear. In common with other tillage tools the shear stress is the result of the soil-leg interface creating a compressive stress in the soil by its forward motion. As can be seen in FIGS. 7–10, the soil failure surface is in two parts: one a triangular plane and the other a conical surface. The former is bounded on one side by the leading edge of the leg, another side by the soil surface and the third side by the conical surface. As for the conical surface, the apex is at the lowest extremity of the leg with the base at the soil surface. The latter can be seen in FIG. 5.

The angle of the failure surface with respect the soil surface is largely a function of the internal soil friction according to the Mohr-Coulomb Failure criterion. The angle, which would be constant for much of the failure surface, varies between some maximum and minimum value for the right hand side of the conical surface.

Like other tillage tools the volume of soil stressed by the models extends beyond the failure surfaces, but the volume to the left and beneath the triangular plane is small provided that the leading edge of the leg is sharp. The largest volume of soil stressed by the model is that which lies ahead of the two failure surfaces and to the right of the conical surface. It is important to note that the conical surface is truncated when there is a prior leg. This can be seen by comparing the conical surfaces (top and bottom) in FIGS. 7 to 10. It is this truncation or localization of the soil stress that largely accounts for the decrease in the draft and in the vertical reaction noted previously between the 150 and 230 mm spacing and the no prior tilling leg in Table 4, and the significant interactions with spacing in Table 3.

While two embodiments of this invention have been illustrated in the accompanying drawings and described hereinabove, it will be evident to those skilled in the art that changes and modifications may be made therein without departing from the essence of this invention, as set forth in the appended claims.

TABLE 1

Deflection of the Bentleg Models for a Concentrated Load at the their Extremity

| Leg Angle (degrees) | Rake angle (degrees) | Deflection (mm) |
|---|---|---|
| 45 | 0 | 22 |
| 45 | 15 | 12 |
| 30 | 15 | 18 |

TABLE 2

Spacing and Depth of 45 Degree Bentleg Models

| Leg Angle (degrees) | Rake angle (degrees) | Depth (mm) | Spacing (mm) |
|---|---|---|---|
| | | | 150 |
| | | 115 | 230 |
| | | | * |
| 45 | 0 | | |
| | | | 150 |
| | | 160 | 230 |
| | | | * |
| | | | 150 |
| | | 115 | 230 |
| | | | * |
| 45 | 15 | | |
| | | | 150 |
| | | 160 | 230 |
| | | | * |
| | | | 210 |
| | | 115 | 315 |
| | | | * |
| 30 | 15 | | |
| | | | 210 |
| | | 160 | 315 |
| | | | * |

*no prior leg

TABLE 3

Analyses of Variance for the 45 Degree Bentleg Models

| Source of Variation | Degrees of Freedom | Mean Square | F-ratio |
|---|---|---|---|
| Draft | | | |
| Blocks | 2 | 2141 | 1.85 |
| Rake Angle (A) | 1 | 4274 | 3.68 |
| Depth (D) | 1 | 47968 | 41.36*** |
| A × D | 1 | 181 | <1 |
| Error (1) | 6 | 1160 | |
| Spacing (S) | 2 | 35538 | 167.82*** |
| S × A | 2 | 278 | 1.31 |
| S × D | 2 | 2181 | 10.30*** |
| S × A × D | 2 | 26 | <1 |
| Error (2) | 16 | 212 | |
| Total | 35 | | |
| Vertical Reaction | | | |
| Blocks | 2 | 128 | 2.07 |
| Rake Angle (A) | 1 | 11953 | 193.73*** |
| Depth (D) | 1 | 5456 | 88.43*** |
| A × D | 1 | 121 | 1.97 |
| Error (1) | 6 | 62 | |
| Spacing (S) | 2 | 1497 | 130.97*** |
| S × A | 2 | 276 | 24.12*** |
| S × D | 2 | 454 | 39.73*** |
| S × A × D | 2 | 12 | 1.06 |
| Error (2) | 16 | 11 | |
| Total | 35 | | |
| Lateral Reaction | | | |
| Blocks | 2 | 79 | 2.75 |
| Rake Angle (A) | 1 | 9545 | 333.96*** |
| Depth (D) | 1 | 2186 | 76.47*** |
| A × D | 1 | 300 | 10.51* |
| Error (1) | 6 | 29 | |

TABLE 3-continued

Analyses of Variance for the 45 Degree Bentleg Models

| Source of Variation | Degrees of Freedom | Mean Square | F-ratio |
|---|---|---|---|
| Spacing (S) | 2 | 553 | 35.36*** |
| S × A | 2 | 270 | 17.24*** |
| S × D | 2 | 380 | 24.30*** |
| S × A × D | 2 | 1 | <1 |
| Error (2) | 16 | 16 | |
| Total | 35 | | |

*5% &
***0.5% level of significance

TABLE 4

Soil Reactions for the 45 Degree Bentleg Models (N/leg)

| | | Draft | Vertical | Lateral |
|---|---|---|---|---|
| Rake Angle (deg) | 0 | (244) | −12 | −6 |
| | 15 | (222) | −48 | 27 |
| Depth (mm) | 115 | 197 | −18 | 3 |
| | 160 | 270 | −42 | 18 |
| Spacing (mm) | 150 | 195 | −21 | 4 |
| | 230 | 209 | −26 | 11 |
| | * | 295 | −43 | 17 |

( ) differences are not significant
*no prior leg

TABLE 5

Analyses of Variance for the Bentleg Models with a Rake Angle and without a Prior Leg

| Source of Variation | Degrees of Freedom | Mean Square | F-ratio |
|---|---|---|---|
| Draft | | | |
| Bent Angle (A) | 1 | 19301 | 46.36*** |
| Depth (D) | 1 | 39670 | 95.29*** |
| A × D | 1 | 453 | 1.09 |
| Error | 8 | 416 | |
| Total | 11 | | |
| Vertical Reaction | | | |
| Bent Angle (A) | 1 | 0 | <1 |
| Depth (D) | 1 | 11604 | 67.08*** |
| A × D | 1 | 1442 | 8.34* |
| Error | 8 | 173 | |
| Total | 11 | | |
| Lateral Reaction | | | |
| Bent Angle (A) | 1 | 6131 | 82.49*** |
| Depth (D) | 1 | 2913 | 39.20*** |
| A × D | 1 | 26 | <1 |
| Error | 8 | 74 | |
| Total | 11 | | |

*5% &
***0.5% level of significance

TABLE 6

Soil Reactions for the Bentleg Models with a Rake Angle and without a Prior Leg (N/leg)

| | | Draft | Vertical | Lateral |
|---|---|---|---|---|
| Bent Angle (deg) | 30 | 361 | (−66) | −7 |
| | 45 | 281 | (−66) | 38 |
| Depth (mm) | 114 | 263 | −35 | 0 |
| | 152 | 378 | −97 | 31 |

TABLE 7

Soil Reactions for the Bentleg Models with a Rake Angle and Prior Leg at Same Depth (N/m)

| | | Draft | Vertical | Lateral |
|---|---|---|---|---|
| Bent Angle (deg) | 45 | (1044) | −213 | 109 |

TABLE 7-continued

| Soil Reactions for the Bentleg Models with a Rake Angle and Prior Leg at Same Depth (N/m) | | | |
|---|---|---|---|
| | Draft | Vertical | Lateral |
| 30 | (1088) | −154 | −55 |

( ) differences are not significant

The embodiments of the invention in which an exclusive property or privilege is claimed are defined as follows:

1. A bentleg plow apparatus having a forward direction, the apparatus comprising:

mounting means, an upper blade-like portion secured to said mounting means and extending generally downward from said mounting means, a lower blade-like portion connected to said upper portion and extending downwardly and laterally therefrom, the lower portion having a rake angle with respect to the forward direction, the rake angle being defined, when the plow apparatus is moving horizontally on a horizontal terrain, as the angle made to the horizontal by the intersection of the lower portion with a vertical plane parallel to said forward direction, the rake angle being such that the lower portion seeks to penetrate further into soil being plowed as the plow apparatus is moved in said forward direction.

2. The invention claimed in claim 1, in which the rake angle is in the range from about 10 degrees to about 20 degrees.

3. The invention claimed in claim 1, in which the upper blade-like portion is secured to the mounting means in such a way that the rake angle can be adjusted.

4. The invention claimed in claim 1, in which the lower portion has a leading edge, and in which a plane parallel to said forward direction and containing said leading edge of the lower portion defines with a horizontal plane an angle between about 15 degrees and about 60 degrees.

5. The invention claimed in claim 4, in which the rake angle is in the range from about 10 degrees to about 20 degrees.

* * * * *